US006896846B1

(12) United States Patent
Varma et al.

(10) Patent No.: US 6,896,846 B1
(45) Date of Patent: May 24, 2005

(54) SYNTHESIS OF ORTHOPAEDIC IMPLANT MATERIALS

(75) Inventors: Arvind Varma, Granger, IN (US); Alexander Mukasyan, Mishawaka, IN (US); Bing-Yun Li, Ruston, LA (US)

(73) Assignee: University of Notre Dame, Notre Dame, IN (US)

( * ) Notice: Subject to any disclaimer, the term of this patent is extended or adjusted under 35 U.S.C. 154(b) by 223 days.

(21) Appl. No.: 10/284,435

(22) Filed: Oct. 31, 2002

Related U.S. Application Data

(60) Provisional application No. 60/335,326, filed on Nov. 2, 2001.

(51) Int. Cl.[7] ..... B22F 3/00

(52) U.S. Cl. ..... 419/45; 75/228; 75/232; 75/236; 75/246

(58) Field of Search ..... 419/45; 75/228, 75/232, 236, 246

(56) References Cited

U.S. PATENT DOCUMENTS 4,131,450 A * 12/1978 Saito et al. ..... 75/352
5,143,668 A * 9/1992 Hida ..... 264/649
5,145,619 A * 9/1992 Abramovici ..... 264/649
5,718,844 A * 2/1998 Krynitz et al. ..... 252/513

* cited by examiner

*Primary Examiner*—Daniel Jenkins
(74) *Attorney, Agent, or Firm*—Jagtiani + Guttag

(57) ABSTRACT

A method for synthesis of biomedical alloys has been developed based on combustion phenomena. This low pressure combustion synthesis (LPCS) technique may be used for production of Co-based and other metal-based alloys, which cover the entire range of orthopaedic implants, including total hip and knee replacements, as well as hone screws, plates, and wires. A unique aspect of the method is that combustion synthesis under low ambient gas pressure allows one to produce pore-free (>99% theoretical density) alloys with high purity and precise chemical and phase compositions.

52 Claims, 9 Drawing Sheets

Prior Art $Co_3O_4$+Al + (Co, Cr, Mo, carbides) ⇒ Co-alloy +$Al_2O_3$

SYNTHESIS OF ORTHOPAEDIC IMPLANT MATERIALS

CROSS-REFERENCE TO RELATED APPLICATIONS

This application makes reference to co-pending U.S. Provisional Patent Application 60/335,326, entitled "Synthesis of Orthopaedic Implant Materials," filed Nov. 2, 2001, the entire disclosure and contents of which is hereby incorporated by reference.

BACKGROUND OF THE INVENTION

1. Field of the Invention

The present invention relates to the synthesis of materials using combustion in powder metallurgy and has particular application to the low pressure combustion synthesis (LPCS) of cobalt-based and other metal-based alloys used in orthopaedic implants, such as hip and knee replacements, screws, plates, dental devices, and artificial heart valves.

2. Description of the Prior Art

About 400,000 hip and knee joints are replaced annually using artificial implants in the United States alone. See *Orthopaedic Network News,* 11, 3 (2000), the entire disclosure and contents of which is hereby incorporated by reference. The ability of orthopaedic implants to provide rapid healing and long-term clinical performance has been proven over many decades to offer patients a high quality of life while minimizing health care costs. Cobalt-chromium-molybdenum (CoCrMo) alloys, specifically cast CoCrMo alloys or wrought CoCrMo alloys generally having an ASTM designation of F-75 or F-1537 respectively (collectively "cobalt alloys"), are used in a wide range of orthopaedic implants, such as total hip and knee replacements, as well as bone screws, plates, and wires. See D. F. Williams, *Biocompatibility of Clinical Implant Materials*, (CRC Press, Inc.), Boca Raton, Fla., 1981; and S. K. Yen, S. W. Hsu, *J. Biomed. Mater. Res.,* 54, 412 (2001), the entire disclosures and contents of which are hereby incorporated by reference. Moreover, a large fraction of dental devices and some cardiovascular prostheses, for example, heart valves, may be produced from these materials. The high use of these materials is because among all implant materials, cobalt alloys demonstrate a balance of resistance to corrosion, fatigue and wear, along with strength and biocompatibility. See D. Granchi, et al., *Biomater.,* 20, 1079 (1999), the entire disclosure and contents of which is hereby incorporated by reference.

Cobalt alloys are generally produced from elemental materials plus recycled scrap metals, employing conventional furnace technology. Due to the high melting points of the main alloy components, approximately 2,000–4,000 K, high temperature furnaces and other complex types of equipment are needed. The overall process usually takes 4–6 hours. The process, therefore, is both time consuming and energy intensive. In addition, this procedure can cause excessive porosity and carbide segregation in the alloy, which may result in microstructural defects in the alloy. Methods such as extrusion and shock-wave loading may be used to densify an alloy, and although sometimes effective, these additional steps add time and expense to the manufacture of cobalt alloys. Thus, a need exists for an improved method of producing cobalt-based alloys.

SUMMARY OF THE INVENTION

Therefore, it is an object of this invention to develop a more efficient and flexible method for production of orthopaedic implants.

A further object, based on the flexibility of the methods of the present invention, is to synthesize new alloys with superior properties.

According to one broad aspect of the present invention, there is provided a method for synthesis of a pore-free cobalt alloy, the method comprising mixing a desired quantity of cobalt oxide powder with a desired quantity of metal powder thereby creating a powder compact; and initiating a chemical reaction within the powder compact under an ambient inert gas pressure of between about 0.08 and about 1.0 atmospheres, to form a pore-free cobalt alloy.

Other objects and features of the present invention will be apparent from the following detailed description of the preferred embodiment.

BRIEF DESCRIPTION OF THE DRAWINGS

The invention will be described in conjunction with the accompanying drawings, in which.

DETAILED DESCRIPTION OF THE PREFERRED EMBODIMENT

Figure 1:
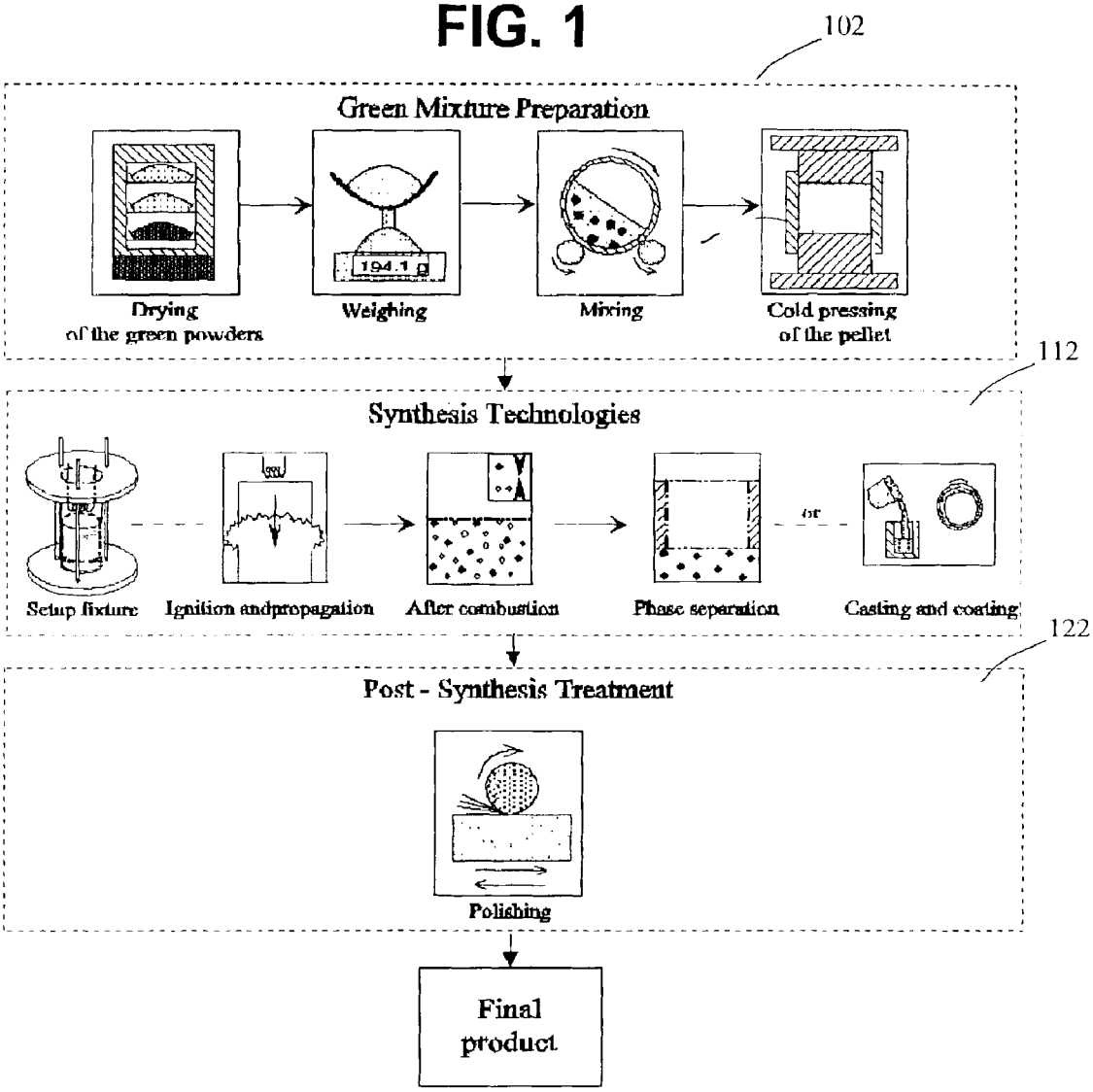
FIG. 1 is a diagrammatic view of the main steps of a preferred embodiment of the present invention.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, the term "low pressure combustion synthesis" refers to a combustion synthesis process using low ambient inert gas pressure (P) on the order of $0.08<P<0.90$ atm.

For the purposes of the present invention, the term "pore-free alloy" refers to an alloy having >99% theoretical density.

For the purposes of the present invention, the term "green mixture" refers to an initial re of reactant powder(s).

For the purposes of the present invention, the term "powder compact" refers to a powder compacted into a ball or other shape.

For the purposes of the present invention, the term "inert gas" refers to the noble gases helium, neon, argon, krypton, xenon and radon gases, as well as any gas that is non-reactive, under the conditions in which the method of the present invention is practiced, with the materials that are reacted with each other to form a particular alloy of the present invention.

For the purposes of the present invention, the term "ambient inert gas pressure" refers to the pressure of an inert gas contained in a reaction chamber around a reaction sample.

For the purposes of the present invention, the term "yield" refers to the ratio of the metal product mass to the theoretical metal mass formed from the reaction.

For the purposes of the present invention, the term "reaction initiated locally" refers to the initiation of a reaction in a discrete location (approximately a volume of 1 $mm^3$) on or within a sample, such that the reaction is then self-sustainable within, on and along the sample.

For the purposes of the present invention, the term "microgravity" refers to an environment in which there is substantially little or no gravitational force.

Description

The method, referred to herein as low pressure combustion synthesis ("LPCS"), allows one to obtain, as explained in more detail below, pore-free cobalt alloy orthopaedic implant materials without applied force in a single step. Using the rapid screening ability of this technique, synthesized novel materials with unique microstructures and enhanced properties may be produced.

The present invention comprises a method for synthesis of biomedical alloys. One feature of this method is a self-sustained combustion reaction, which is initiated locally by an external heating source, such as a tungsten coil, or laser, which then propagates rapidly through a heterogeneous mixture of reactants in the form of a combustion wave. After cooling, the desired alloy is obtained.

The present invention provides benefits as compared to known combustion synthesis (CS) technologies, such as the use of basic green mixture compositions (i.e., use of oxides and reducing metals); specialized synthesis conditions using ranges of inert gas pressure in the reaction chamber; and special additives leading to enhanced material properties.

The present invention provides for LPCS, which is beneficial as compared to conventional technologies of Co-based alloy production, in that the present invention provides for energy efficiency; short production duration to achieve effectiveness; simplified equipment; and the possibility for one-step article production. For example, according to a preferred embodiment of the present invention, one pound of a CoCrMo alloy, with properties comparable to those of conventionally produced materials, may be produced in about 1 minute using electrical power of about 100 W.

A method for production of cast alloys or articles by combustion synthesis consists of three main steps: (1) preparation of a green mixture; (2) high temperature synthesis: and (3) post-synthesis treatment. A schematic diagram of these steps is presented in FIG. 1.

The first main step 102 in FIG. 1 is similar to those commonly used in powder metallurgy, in which reactant powders (such as $CO_3O_4$, Co, CoO, $CoMoO_4$, chromium (Cr), molybdenum (Mo), aluminum (Al), Magnesium (Mg), Zirconium (Zr), etc.) may be (i) dried under a vacuum at approximately 80–100° C.; (ii) weighed into appropriate amounts (for example, to produce 1 kg of alloy, one needs approximately 649.1–788.16 g, preferably approximately 649.87 g, of $CO_3O_4$; approximately 157.56–226.72, preferably approximately 159.06 g, of Co; approximately 270–300 g, preferably approximately 296.17 g, of Cr, approximately 50–70 g, preferably approximately 67.70 g, of Mo and approximately 193.92–235.44 g, preferably approximately 194.06 g, of Al); (iii) thoroughly mixed (e.g., ball mixing) for 5 hours to homogenize reaction media; and (iv) finally, the thus prepared green mixture may be cold pressed into cylindrical pellets (e.g., approximately 20 mm in diameter and 40 mm in height) up to a density in the range of approximately 2.9–3.3 $g/Cm^3$.

The second main step 112 is combustion synthesis of the alloy. For this step to eliminate horizontal spreading of liquid products, as well as to avoid possible metal splash on the reaction chamber wall, pressed pellets may be inserted in, for example, a quartz tube with, for example, a 42-mm inner diameter covered from both sides by ceramic (BN, $SiO_2$, etc.) plugs. The tube may then be constrained in a specially designed fixture and placed in a stainless steel, or other corrosion resistant material, reaction chamber of, for example, 400-mm high and having an inner diameter of 320 mm.

Figure 2:
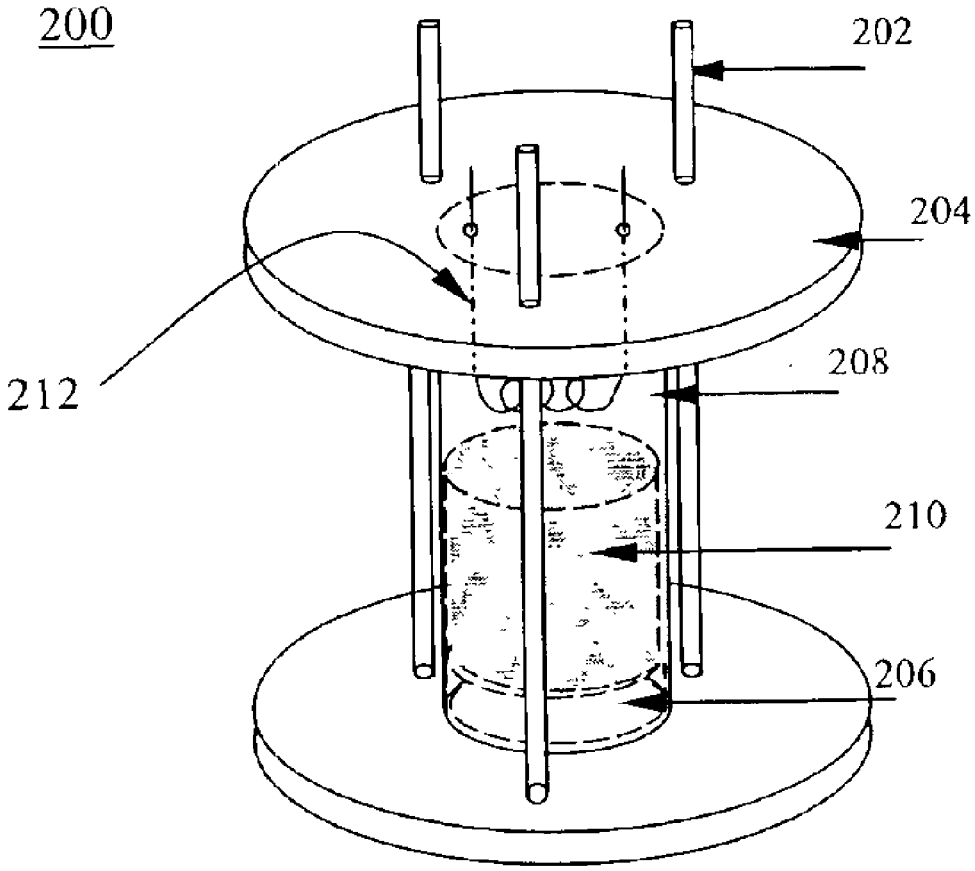
FIG. 2 is a schematic view of a reaction chamber according to a preferred embodiment of the present invention.

A suitable reaction chamber 200 is shown in detail in FIG. 2. Reaction chamber 200 includes constraints 202 that provide structural support, cover 204, for example constructed of BN, $SiO_2$, etc., holder 206, for example constructed of BN, $SiO_2$, etc., and quartz tube 208. A sample 210 may be placed in chamber 200 for carrying out the reaction. Chamber 200 preferably does not react with any of the reagents and should be capable of withstanding the reaction processes of the present invention.

Before reaction initiation, chamber 200 may be sealed, evacuated and purged with inert gas (Argon, Helium, etc.) for approximately three cycles and then filled with inert gas to the desired pressure. A coil 212, for example, made of tungsten, may be positioned ~2 mm above sample 210, and electrically heated until the reaction is initiated locally, followed by turning the power off, while the reaction wave propagates along the sample. If it is desired to produce an article of a specific shape and dimension, this process may also include alloy casting to the desired mold.

According to a preferred embodiment of the present invention, a reaction chamber may be evacuated to a pressure of between about 0.0001 atm and about 0.05 atm, preferably about 0.005 atm. The chamber may then be filled with an inert gas, such as, for example, Argon or Helium, to a pressure of between about 0.08 atm and about 1.0 atm, preferably between about 0.15 atm and about 0.18 atm, for example about 0.16 atm.

Heating of the sample may be conducted using any heating device that allows local preheating of reaction media to the reactant melting point temperature, such as 933 K for Al. Suitable heating elements include a laser or electrically heated wire. To initiate a reaction in the system of the present invention, a sample volume (~1 $mm^3$) may be preheated locally to the temperature equal to the melting point of a reactant powder (such as Al with T m.p.=933 K). After preheating, the ignition device (electrical wire, laser, etc.) may be immediately turned off, to allow the reaction wave to propagate along the sample in a self-sustained mode. The duration of preheating is generally extremely short, such as approximately 1–5 seconds, preferably approximately 1 second or more.

In particular embodiments of the present invention, a suitable combustion synthesis temperature may be higher than the melting point of $Al_2O_3$ but low enough to ensure that the process does not produce more than 0.005 mol of gas phase products.

In particular embodiments of the present invention, the ambient inert gas pressure (P) may be approximately $0.08<P<0.90$ atm. Optimum pressure depends on several factors, including the amount of additives, such as carbon, nitrogen, etc., in the alloy.

The third main step 122, i.e. post-synthesis treatment, is optional, since not all products require additional processing after synthesis. Annealing at an elevated temperature such as approximately 800–1200° C. may be used to remove residual thermal stress in CS-products. The articles may also be machined into specified shapes and/or surface finishes.

An alloy produced by a method of the present invention may preferably correspond to the requirements of the F75-98 standards for Co-based alloys.

Figure 3A:
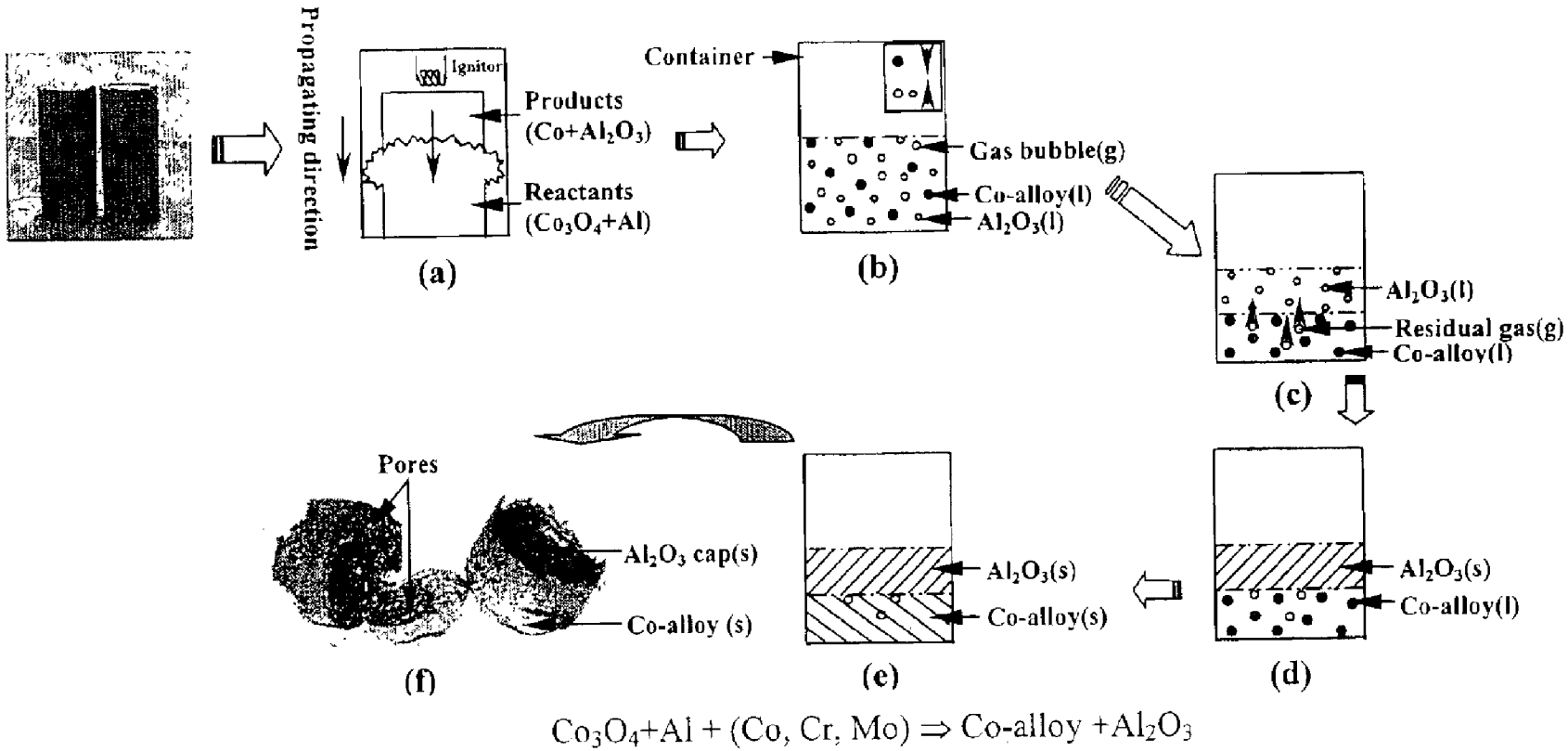
FIG. 3A is a diagrammatic view one of two alternate pathways in Co-alloy synthesis, showing the result of a known method (f)

For calculated optimum compositions, experiments conducted under normal ambient pressure, have shown that gas released in the high temperature reaction zone may lead to the formation of pores and cavities in the final products (FIG. 3A, route a→f). Such defects are due to the crystallization of an $Al_2O_3$ "cap" on top of the melt Co-alloy product at high temperature, which prevents gas escape and leads to an undesired porous microstructure.

Figure 4:
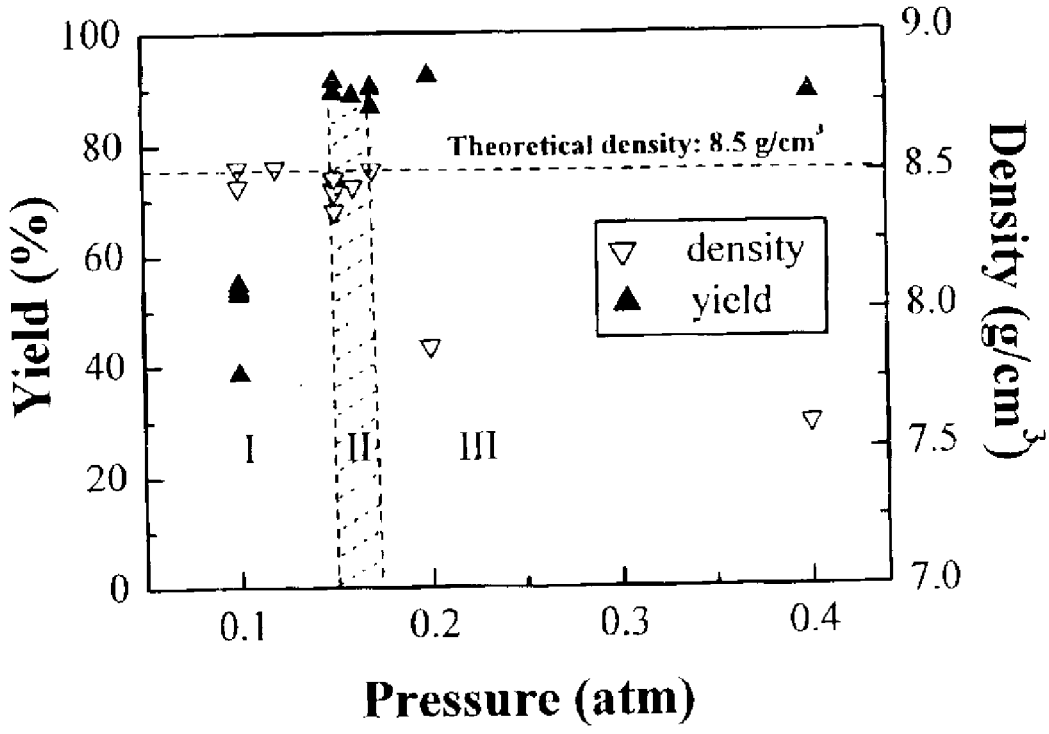
FIG. 4 is a chart showing the influence of ambient gas pressure on alloy density and yield.

An aspect of the present invention is that low ambient gas pressure allows one to achieve a pore-free (>99% theoretical density) alloy at high yield (>90%). The yield is defined here as the ratio of the metal product mass to the theoretical metal mass formed from the reaction. As shown in FIG. 4, at pressures lower than 0.15 atm (region I), a pore-free alloy may be produced but the yield is only 60% or lower. On the other hand, at pressures exceeding 0.2 atm (region III), the yield is more than 90% but the material density is too low. Thus, there exists a narrow window of ambient gas pressures (region II) (0.15–0.18 atm) in which both yield and density simultaneously possess acceptably high values.

Figure 3B:
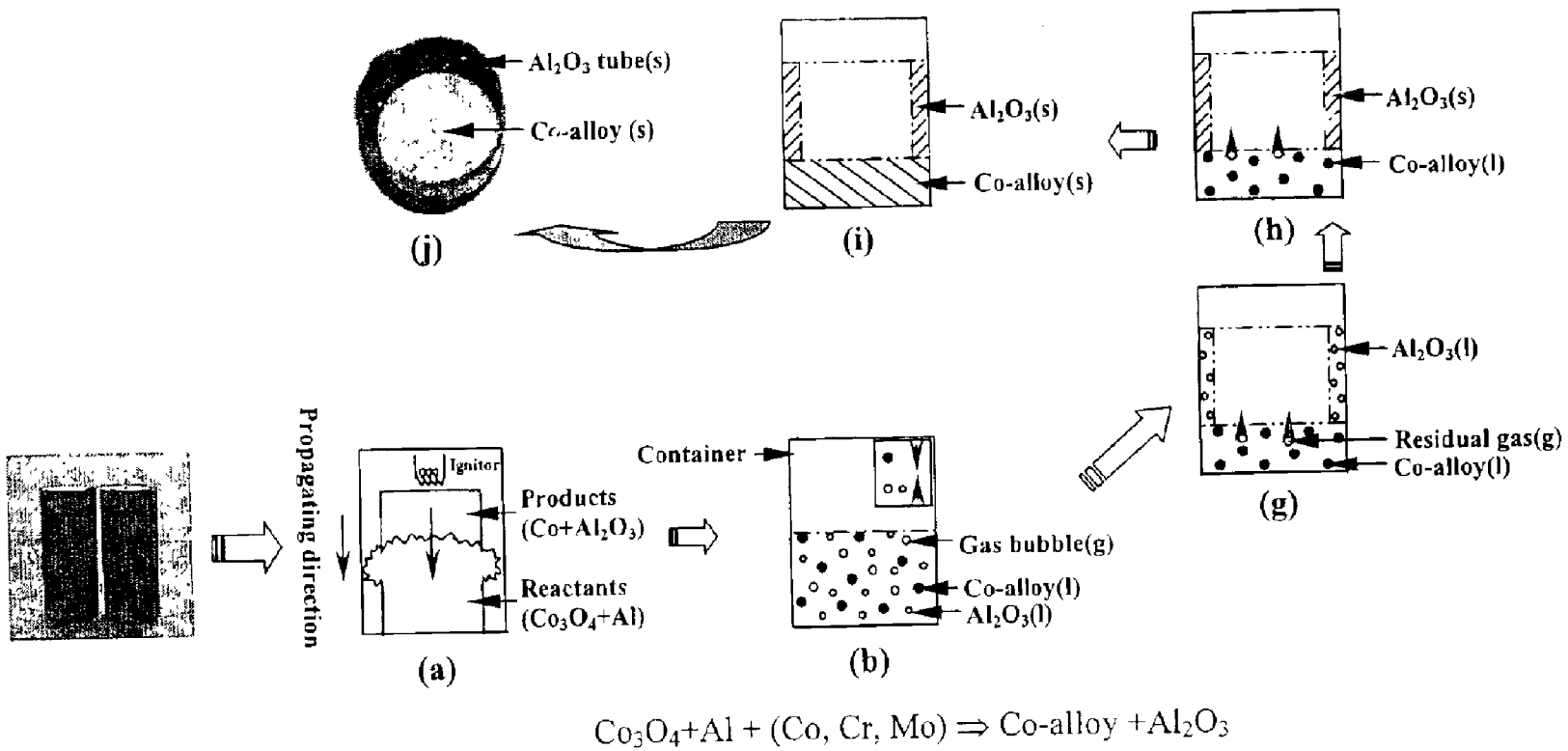
FIG. 3B is a diagrammatic view a second of two alternate pathways in Co-alloy synthesis, showing the result of a method according to a preferred embodiment of the present invention (j)

Referring to FIG. 3B showing a preferred embodiment of the present invention, the compact pressed from a composition, such as $3Co_3O_4+8Al+(xCo, yCr, zMo)$, may be placed in a container (e.g., a quartz tube) and inserted in the metal reaction chamber, preferably constructed of stainless steel. The chamber is pumped down to a pressure of approximately $10^{-3}$ atm, followed by a step of filling the chamber with inert (Argon, Helium, etc.) gas up to relatively low pressure (such as approximately 0.16 atm). The powder compact is locally (~1 $mm^3$) preheated for a short duration (~1 s) by an external power source, such as a laser, up to temperature of ~933–950 K to initiate a reaction. After initiation, the external power source is switched off, and the reaction propagates in a self-sustained manner along the compact resulting in formation of a Co-based alloy and aluminum oxide ($Al_2O_3$) slag. Immediately after reaction, phase separation between slag and alloy takes place according to route a-b-g→j (FIG. 3B).

If ambient gas pressure is in the range shown in region III (FIG. 4), phase separation occurs following route (a)→(f) as shown in FIG. 3A, with formation of an $Al_2O_3$ cap on the top of a metal ingot, which introduces cavities and pores. When the ambient pressure is in the ranges shown in regions I and II (FIG. 4), instead of a cap, $Al_2O_3$ separates from the metal alloy in the form of a thin (~1 mm) tube coating the internal surface of the container (FIG. 3B, route a-b-g→j). The formation of this tube, as opposed to a cap, permits released gas to fully escape from the melt alloy bulk, thus leading to a pore-free material. However, in region I (FIG. 4), yield is reduced owing to partial alloy-product blowout, which occurs as a result of the larger pressure gradient existing between the alloy and the ambient atmosphere. Thus, the desired proper balance between full gas release and high yield is achieved in region II (FIG. 4).

According to particularly preferred embodiments of the present invention, cobalt alloys may comprise approximately 63% to 68% by weight of cobalt (Co); approximately 27% to 30% by weight of chromium (Cr); and approximately 5% to 7% by weight of molybdenum (Mo). However, those skilled in the art will appreciate that the specific composition(s) of the starting materials may be altered in order to achieve the desired material and mechanical properties of the final cobalt alloy.

An exemplary reaction according to the present invention may be written as follows:

$$3Co_3O_4+8Al+(xCo, yCr, zMo) \Rightarrow 4Al_2O_3+9(\text{cobalt-based alloy}),$$

wherein Al is the reducing agent, and x, y and z coefficients can be varied to obtain the desired compositions and combustion temperatures. For example, x may be 3.0, y may be 6.0 and z may be 0.7.

Figure 5:
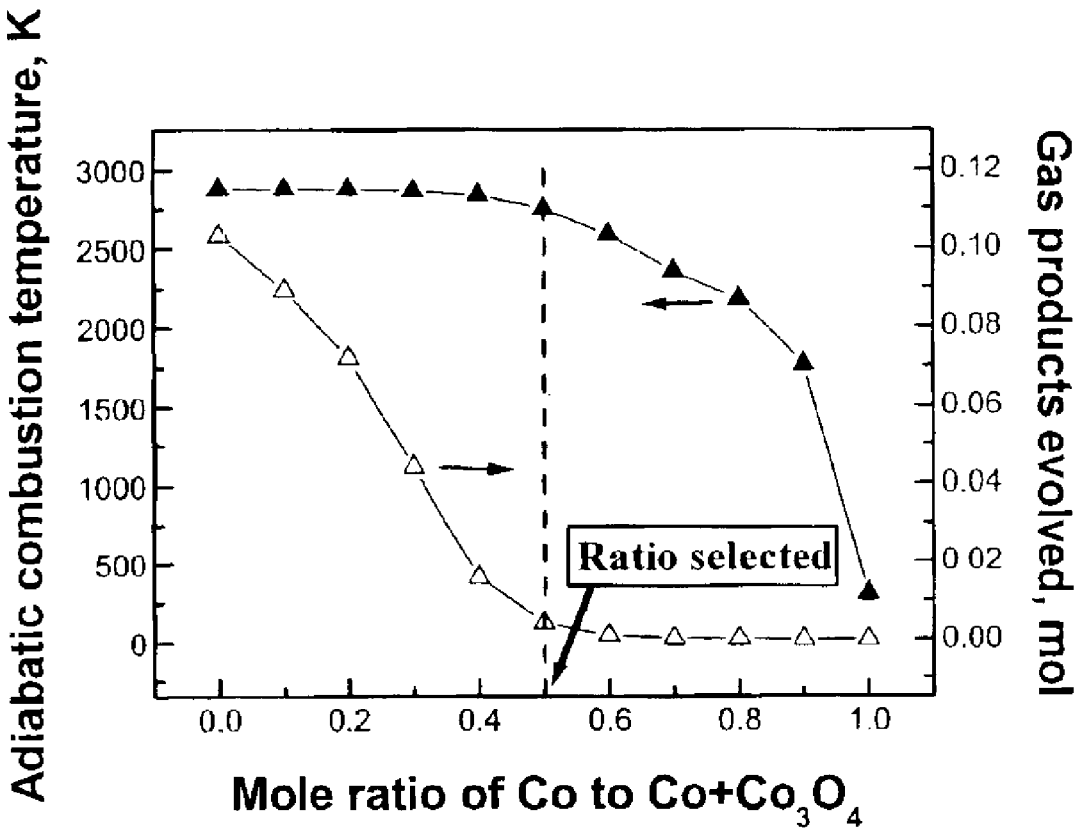
FIG. 5 is a chart showing the dependence of adiabatic combustion temperature and gas product evolution on a basic reactant mixture composition according to a preferred embodiment of the present invention.

Thermodynamic analysis shows that the adiabatic combustion temperature ($T_{ad}$) for the above reaction at 1 atm Argon ambient atmosphere may be as high as 2,900 K (x=0; y=4.5; z=0.5) (FIG. 5). By increasing Co content in the initial mixture (i.e., the value of x), $T_{ad}$ decreases continuously, while the amount of gaseous products (including Cr, Co, Al, oxides, etc.) decreases, reaching a minimum at 0.6 mole ratio of Co to ($Co+CO_3O_4$). Thus, having $T_{ad}$ higher than the melting points of $Al_2O_3$ ($T_{mp,Al_2O_3}$~2,300 K) and the Co-based alloy ($T_{m.p.,alloy}$~1,768 K), provides full separation and a homogeneous composition distribution along with a low amount of gas products. In particular embodiments of the present invention, a 0.5 mole ratio of Co to ($Co+CO_3O_4$) may be preferably used as the basic reactant composition.

Figure 6:
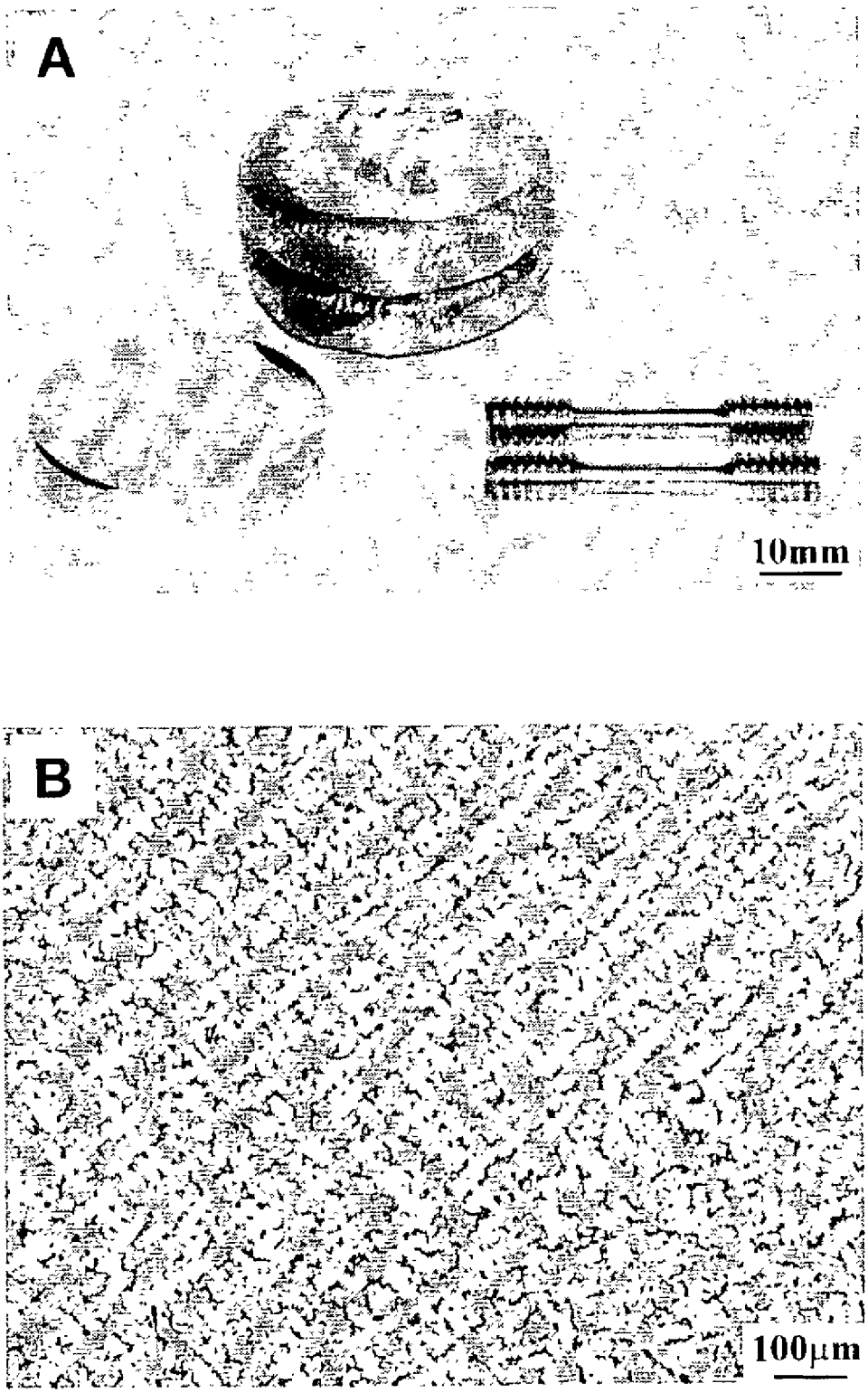
FIG. 6A shows synthesized samples and machined specimens for testing.
FIG. 6B shows a typical micrograph of a pore-free CoCrMo material produced by a method according to a preferred embodiment of the present invention.

FIG. 6A shows synthesized Co-alloy ingots produced by LPCS according to a method of the present invention, along with machined test specimens. FIG. 6A shows that disks with smooth surfaces may be produced. In addition, no cavities or pores are observed in the microstructure, as shown in FIG. 6B. Chemical analysis shows that the alloy compositions match well with the ASTM F75 standard specifications and exhibit extremely low levels of impurities, see Table 1 below. Note that high purity is important in orthopaedic implants; for example, it has been reported that Ni possesses allergic potential, and Si may cause embrittlement. The present invention successfully combines two important features of self-densification and self-purification, since high-purity pore-free materials may be produced in one step using a porous mixture of lower cost oxides, instead of pure metals.

TABLE 1

Chemical composition (wt. %) of the CoCrMo alloy produced by LPCS and related ASTM standard specifications.

| Composition | | Co | Cr | Mo | Si | W | C | Al | Fe | Mn | Ni | P | B | N |
|---|---|---|---|---|---|---|---|---|---|---|---|---|---|---|
| F75-98 | min | bal | 27.0 | 5.0 | — | — | — | — | — | — | — | — | — | — |
| | max | bal | 30.00 | 7.00 | 1.00 | 0.20 | 0.35 | 0.30 | 0.75 | 1.00 | 1.00 | 0.020 | 0.01 | 0.25 |
| LPCS-CoCrMo | | bal | 28.01 | 6.47 | 0.076 | 0.13 | 0.019 | 0.20 | 0.11 | 0.085 | 0.08 | 0.009 | <0.0005 | 0.0058 |

Figure 7:
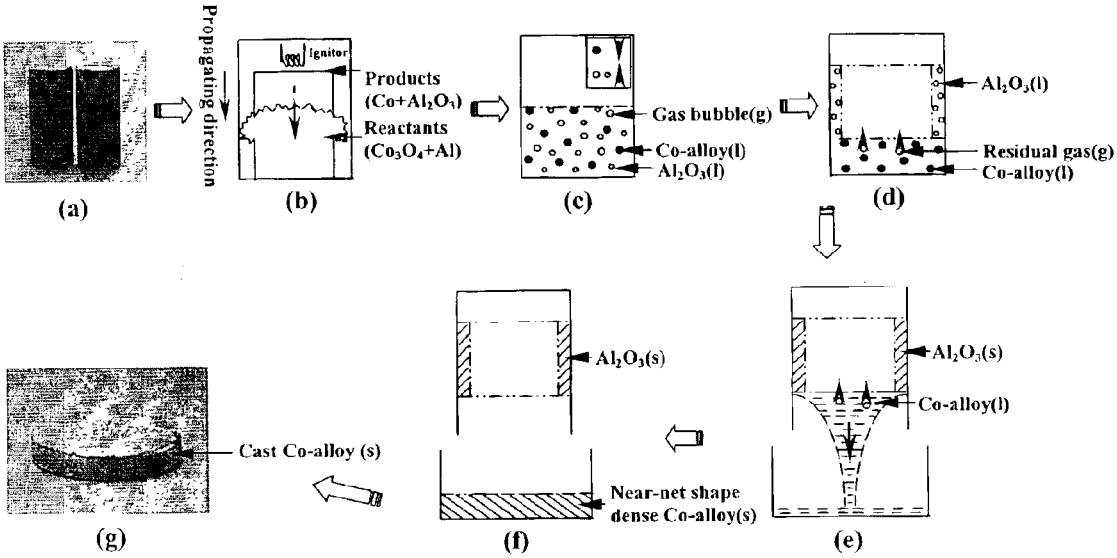
FIG. 7 shows a method according to a preferred embodiment of the present invention in which LPCS may be combined with direct casting.

As mentioned above, according to a particular embodiment of the present invention, alloys of the present invention may be cast into various desired shapes and dimensions, as shown in FIG. 7. The desired shape may then be machined to provide a suitable finish and to fine-tune any shaping requirements.

The aforementioned concept of LPCS, i.e. achieving full release of residual gas formed during rapid high temperature reaction by adjusting ambient gas pressure, may also be used in other reaction systems to produce pore-free alloys, ceramics, intermetallics and composites. For example, synthesis of dense stainless steel based biomaterials using this technology may be done as follows:

$$Fe_2O_3+2Al+(Cr, Mo) \Rightarrow Al_2O_3+\text{stainless steel alloy.}$$

Figure 8:
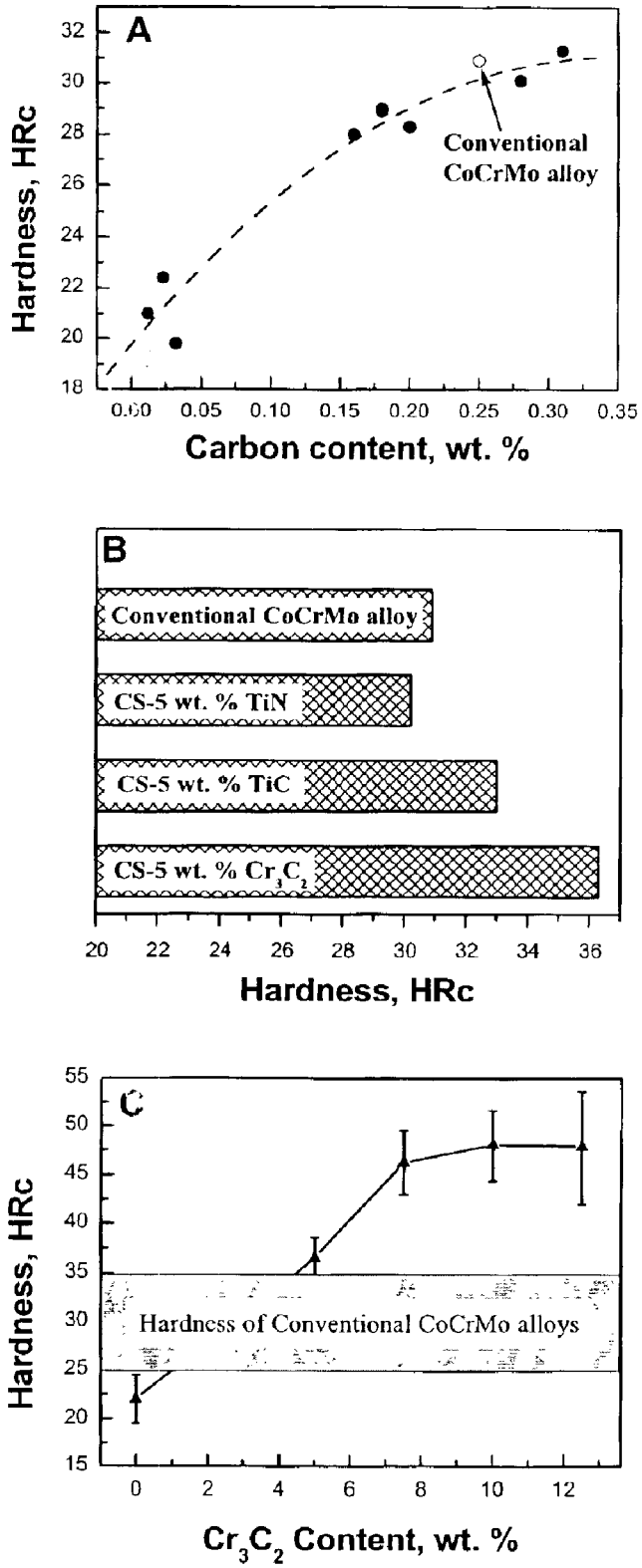
FIGS. 8A, 8B and 8C show the influence of different additives on hardness of Co-based alloys produced by a method according to a preferred embodiment of the present invention.

Using the rapid screening ability of the LPCS method of the present invention, an investigation of a wide range of material compositions may be conducted. In this context, graphite, carbon black, metals, carbides and nitrides (e.g., Cr, Mo, titanium (Ti), TiC, $Cr_3C_2$, TiN, $Cr_7C_3$, $Mo_2C$, etc.) may be used as additives to synthesize novel materials with superior properties, see Table 2 below for properties for various additives. For example, it is known that carbon enhances mechanical properties in cast CoCrMo alloys, which was also confirmed in FIG. 8A. With respect to the method of present invention, it has also demonstrated that, among the various additives, $Cr_3C_2$ is very effective for increasing material hardness, sec FIG. 8B. The hardness of alloys with different amounts of $Cr_3C_2$ is shown in FIG. 8C. These values are significantly higher than those exhibited by alloys synthesized using conventional techniques, such as wrought CoCrMo alloys, see R. H. Shetty, et al., in: *Encyclopedic Handbook of Biomaterials and Bioengineering*, New York, part B 1, 509 (1995), the entire contents and disclosure of which is hereby incorporated by reference herein. This enhancement owes to the fine and uniform microstructure that results from the LPCS conditions of the present invention.

homogeneously. However, metal carbides, which have a lower melting point (e.g., the melting point for $Cr_3C_2$ is 2,168 K), may be added directly to the initial reactant mixture. In this case, owing to high temperatures in the combustion wave (~2,900 K), these carbides may be melted and distributed uniformly during LPCS, while the carbides remain in the original solid state during the relatively low temperature (~2,000 K) involved in a conventional casting technique. These features permit LPCS-alloys to attain hardness up to 46 HRc, approximately 50% higher than conventional alloys with the same carbon content (0.33 wt. %).

It is generally believed that phase separation in thermite systems is controlled by gravity-driven buoyancy, which occurs due to the difference in densities of the products: metal (e.g., $\rho_{Co}$=8.3 g/cm$^3$) and slag (e.g., $\rho_{Al2O3}$=2.7 g/cm$^3$). See V. I. Yukhvid, *Pure & Appl. Chem.,* 64, 977 (1992); A. G. Merzhanov, V. I. Yukhvid, and I. P. Borovinskay, *Dokl. Chem. Phys.,* 255, 503 (1979); V. I. Yukhvid, *Izv. Akad. Nauk. SSSR. Metal,* 6, 61 (1980); and A. M. Bulaev, *Comb. Explos. & Shock Waves,* 28, 395 (1992), the entire contents and disclosures of which are hereby incorporated by reference. However, the present invention may be used in microgravity environments as well.

Combustion synthesis involving various thermite systems (e.g., $CO_3O_4$—Al; $MoO_3$—Al and $V_2O_5$—Al) with different ratios of metal/$Al_2O_3$ densities, such as V ($\rho_v$=6.11 g/cm$^3$), Co ($\rho_{Co}$=8.92 g/cm$^3$), Mo ($\rho_{Mo}$=10.22 g/cm$^3$) and ($\rho_{Al2O3}$=2.8 g/cm$^3$), were studied under different gravity conditions (in the range $10^{-5}$–1.7 g) to determine the effect of buoyancy on phase segregation. Since a high level (~93%) of phase separation may be achieved under microgravity, the present invention has shown that some non-gravity-driven mechanisms play a role during CS of Co-based and Mo-based alloys. See Lau, C., Mukasyan, A. S. and Varma, A., *Materials Synthesis by Reduction-Type Combustion Reaction: Influence of Gravity*, Proceedings of the Combustion Institute, 29, 2002 (in press), the entire contents and disclosure of which is hereby incorporated by reference.

TABLE 2

Synthesis pressures for CS Co-alloys with additives.

| | Additive | | | | | |
|---|---|---|---|---|---|---|
| | Carbon Black | | | | Graphite | $Cr_3C_2$ |
| wt. % carbon | 0 | 0.25 | 0.35 | 0.5 | 0.5 | 0.5 |
| Optimum pressure, atm | 0.15–0.18 | 0.15–0.26 | 0.32–0.40 | 0.8–1.0 | 0.15–0.4 | 0.08–0.2 |
| Yield, % | 91 | 83 | 78 | 83 | 85 | 80 |
| Porosity, % | <1 | <1 | <1 | <1 | <1 | <1 |

Carbon has a high melting point (~3,800 K) and hence does not melt under conventional synthesis or LPCS conditions, so that it is difficult to distribute formed carbides The present invention has shown that the two-stage phase separation process: (i) separation of immiscible liquid in the reaction front; and (ii) capillary spreading of the alloy in a solid matrix, not only helps explain the observed microstructural transformation during CS, but also helps explain the observed effect of essentially complete phase separation achieved in microgravity conditions.

Furthermore, the present invention has shown that the first three systems identified above, i.e. $CO_3O_4$—Al; $MoO_3$—Al; $Fe_2O_3$—Al, possess similar behaviors and thus the methods of the present invention may be applicable for production of pore-free alloys based on such systems. However, in the latter $V_2O_5$—Al system, full phase separation may not be achieved under 1 g conditions.

This effect can be understood by taking into account two issues. First, the volume of liquid metal (e.g., Co or V) in the reaction front should exceed some critical value (the so-called percolation limit) so that metal drops may form a continuous skeleton structure. In this case, surface tension rapidly leads to the separation of two phases. For example, in the case of a $CO_3O_4$—Al system, the suggested composition range provides ~50 vol. % of metal in the reaction front, which is above the critical value (~45 vol. %), while for a $V_2O_5$—Al system, the amount of liquid metal is only ~35%.

Also, specific features of the binary phase diagram (Me—$Al_2O_3$) are important, i.e. at a particular temperature, these two phases (eg., Co and $Al_2O_3$) should be immiscible resulting in their rapid separation. Since ternary complex oxides (V—Al—O) may exist along the entire temperature range in a $V_2O_5$—Al system, gravity driven buoyancy (and not a surface tension-based mechanism) generally leads to their full separation in a post-combustion zone. In addition, in this situation, normal gravity conditions (1 g) under relatively short process durations are not sufficient, thus additional (e.g., centrifugal) forces may need to be applied to enhance the process and reach full separation.

Although the present invention has been fully described in conjunction with the preferred embodiment thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. A method for synthesis of a pore-free cobalt alloy, said method comprising the following steps:

(a) mixing a desired quantity of cobalt oxide powder with a desired quantity of metal powder thereby creating a powder compact; and (b) initiating a chemical reaction within the powder compact by locally heating the powder compact under an ambient inert gas pressure of between about 0.08 atmospheres and about 1.0 atmospheres, to form a pore-free cobalt alloy.

2. The method of claim 1, wherein said metal powder comprises aluminum.

3. The method of claim 1, wherein said metal powder comprises magnesium.

4. The method of claim 1, wherein said metal powder comprises zirconium.

5. The method of claim 1, wherein step (b) comprises locally heating the powder compact to a temperature of between about 933 K and about 950 K.

6. The method of claim 1, wherein step (b) comprises locally heating the powder compact for between about 1 second and about 5 seconds.

7. The method of claim 1, wherein step (b) comprises locally heating the powder compact for about 1 second.

8. The method of claim 1, wherein step (b) is carried out in the presence of argon gas.

9. The method of claim 1, wherein the step (b) is carried out in the presence of helium gas.

10. The method of claim 1, further comprising adding to said powder compact a hardness increasing metal to increase the hardness of the pore-free alloy.

11. The method of claim 10, wherein said hardness increasing metal comprises chromium.

12. The method of claim 10, wherein said hardness increasing metal comprises molybdenum.

13. The method of claim 10, wherein said hardness increasing metal comprises titanium.

14. The method of claim 1, further comprising adding to said powder compact carbon to increase the hardness of the pore-free alloy.

15. The method of claim 1, further comprising adding to said powder compact a carbide to increase the hardness of the pore-free alloy.

16. The method of claim 15, wherein said carbide comprises $Cr_3C_2$.

17. The method of claim 15, wherein said carbide comprises $Cr_7C_3$.

18. The method of claim 15, wherein said carbide comprises $Mo_2C$.

19. The method of claim 15, wherein said carbide comprises TiC.

20. The method of claim 1, further comprising adding to said powder compact a nitride to increase the hardness of the pore-free alloy.

21. The method of claim 20, wherein said nitride comprises TiN.

22. The method of claim 1, wherein said reaction initiating step is carried out under an ambient inert gas pressure of between about 0.15 atmospheres and about 0.18 atmospheres.

23. The method of claim 1, wherein said reaction is carried out in a reaction chamber and wherein, prior to step (b), gas pressure in said reaction chamber is evacuated to a pressure of between about 0.0001 atmospheres and about 0.05 atmospheres.

24. The method of claim 1, wherein said reaction is carried out in a reaction chamber and wherein, prior to step (b), gas pressure in said reaction chamber is evacuated to a pressure of about 0.005 atmospheres.

25. A cobalt alloy made according to the method of claim 1.

26. A method for synthesis of a pore-free alloy, said method comprising the following steps:

(a) mixing a desired quantity of metal oxide powder with a desired quantity of metal powder thereby creating a powder compact; and (b) initiating a chemical reaction within the powder compact by locally heating the powder compact under an ambient inert gas pressure of between about 0.08 atmospheres and about 1.0 atmospheres, to form a pore-free metal alloy.

27. The method of claim 26, wherein said metal oxide powder comprises molybdenum.

28. The method of claim 26, wherein said metal oxide powder comprises iron.

29. The method of claim 26, wherein said metal powder comprises aluminum.

30. The method of claim 26, wherein said metal powder comprises magnesium.

31. The method of claim 26, wherein said metal powder comprises zirconium.

32. The method of claim 26, wherein step (b) comprises locally heating the powder compact to a temperature of between about 933 K and about 950 K.

33. The method of claim 26, wherein step (b) comprises locally heating the powder compact for between about 1 second and about 5 seconds.

34. The method of claim 26, wherein step (b) comprises locally heating the powder compact for about 1 second.

35. The method of claim 26, wherein step (b) is carried out in the presence of argon gas.

36. The method of claim 26, wherein the step (b) is carried out in the presence of helium gas.

37. The method of claim 26, further comprising adding to said powder compact a hardness increasing metal to increase the hardness of the pore-free alloy.

38. The method of claim 37, wherein said hardness increasing metal comprises chromium.

39. The method of claim 37, wherein said hardness increasing metal comprises molybdenum.

40. The method of claim 37, wherein said hardness increasing metal comprises titanium.

41. The method of claim 26, further comprising adding to said powder compact carbon to increase the hardness of the pore-free alloy.

42. The method of claim 26, further comprising adding to said powder compact a carbide to increase the hardness of the pore-free alloy.

43. The method of claim 42, wherein said carbide comprises $Cr_3C_2$.

44. The method of claim 42, wherein said carbide comprises $Cr_7C_3$.

45. The method of claim 42, wherein said carbide comprises $Mo_2C$.

46. The method of claim 42, wherein said carbide comprises TiC.

47. The method of claim 26, further comprising adding to said powder compact a nitride to increase the hardness of the pore-free alloy.

48. The method of claim 47, wherein said nitride comprises TiN.

49. The method of claim 26, wherein said reaction initiating step is carried out under an ambient inert gas pressure of between about 0.15 atmospheres and about 0.18 atmospheres.

50. The method of claim 26, wherein said reaction is carried out in a reaction chamber and wherein, prior to step (b), gas pressure in said reaction chamber is evacuated to a pressure of between about 0.0001 atmospheres and about 0.05 atmospheres.

51. The method of claim 26, wherein said reaction is carried out in a reaction chamber and wherein, prior to step (b), gas pressure in said reaction chamber is evacuated to a pressure of about 0.005 atmospheres.

52. A metal alloy made according to the method of claim 1.

* * * * *